US006695179B2

(12) United States Patent
Mandile

(10) Patent No.: US 6,695,179 B2
(45) Date of Patent: Feb. 24, 2004

(54) VARIABLE-LENGTH DIP TUBE FOR A FLUID TRANSFER CONTAINER

(75) Inventor: Frank Mandile, Grays Point (AU)

(73) Assignee: Visy Industrial Plastics Pty Ltd, Victoria (AU)

( * ) Notice: Subject to any disclaimer, the term of this patent is extended or adjusted under 35 U.S.C. 154(b) by 0 days.

(21) Appl. No.: 10/204,840

(22) PCT Filed: Feb. 26, 2001

(86) PCT No.: PCT/AU01/00200

§ 371 (c)(1),
(2), (4) Date: Nov. 18, 2002

(87) PCT Pub. No.: WO01/62627

PCT Pub. Date: Aug. 30, 2001

(65) Prior Publication Data

US 2003/0089744 A1 May 15, 2003

(30) Foreign Application Priority Data

Feb. 24, 2000 (AU) ..... PQ5909

(51) Int. Cl.[7] ..... B67D 5/60
(52) U.S. Cl. ..... 222/464.3; 222/211
(58) Field of Search ..... 222/464.3, 464.5, 222/464.1, 464.7, 382, 211; 221/85

(56) References Cited

U.S. PATENT DOCUMENTS

| | | | | |
|---|---|---|---|---|
| 2,344,005 A | * | 3/1944 | Sundholm | 222/382 |
| 3,409,184 A | * | 11/1968 | Stengle, Jr. | 222/207 |
| 5,186,365 A | | 2/1993 | Nolte | |
| 5,557,895 A | | 11/1996 | Bendrell | |

FOREIGN PATENT DOCUMENTS

FR 2746089 9/1997

* cited by examiner

*Primary Examiner*—Gene Mancene
(74) *Attorney, Agent, or Firm*—Paul & Paul

(57) ABSTRACT

A dip tube of variable length which can be connected to a valve or pump and be inserted through an opening in the top end of a container to accommodate full extraction of liquid contents from containers of varying height. The variable length of the dip tube is accomplished by making the dip tube in two sections, the shorter section of a flexible plastics material and comprising a flexible bellows portion that contracts and extends in length while over the lower end of the longer section, in a freely moving but directionally guided manner, so that the flexible bellows cannot bend excessively. The bellows portion allows the length of the dip tube to vary so that its lower end contacts the bottom of the container. It is adapted to be used in returnable circuit containers for dangerous goods, fitted with dry-break or dripless valves.

12 Claims, 2 Drawing Sheets

VARIABLE-LENGTH DIP TUBE FOR A FLUID TRANSFER CONTAINER

FIELD OF INVENTION

The field of invention relates to container apparatus and more particularly relates to a variable-length dip tube suitable for connection to a pump or valve at an opening of a container. It is particularly useful in the field of chemical transfer drums or tank-like containers designed for returnable circuit use and equipped with dry-break (dripless) valve(s) in an upper wall.

BACKGROUND OF THE INVENTION

Dry-break valves in drum containers find widespread application in the agricultural and veterinary fields, for example. In those fields, toxic, concentrated liquid herbicides, insecticides and lousicides, among other substances, are provided for dilution preceding application to farm crops and animals, as the case may be. A widespread delivery method involves 110 litre (30 US gallon) capacity drums that have, in the head (upper end) of the drum, a dry-break valve such as one provided by Micromatic Operations Inc of Holland, Mich. The particular valve employed is not crucial to the invention, nor is the capacity of the drum.

The Micromatic valve has a polyethylene dip tube that leaves room for improvement. Many of the typically contained dangerous substances that are packaged in returnable circuit containers are prone to cause environmental stress-cracking. This combined with shape and usage stress factors cause the known dip tube to fail by mechanisms including excessive bending resulting in blocking off the end or cracking at the end. This prevents full removal of contents, resulting in dissatisfaction.

The present invention, described more fully below, seeks to avoid those disadvantages.

SUMMARY OF THE INVENTION

The invention provides a variable-length dip tube suitable for connection to a closure for a container comprising: a first tube and a second tube, one of which is attachable to a closure for a container, the first tube is of a fixed length and is adapted to fit inside the second tube, the second tube has a collapsible and extensible portion intermediate an upper and lower and portions of the second tube, at least a part of the upper end portion being in fluid tight contact with the first tube at a distance from the lower end of the first tube, said collapsible and extensible portion and said lower end portion being a loose clearance fit over the first tube.

The dip tube is usually inserted through a threaded opening in the top end of a container, with the opening of the container then made leak tight by screwing in the pump or valve, via an adaptor, to the opening. Dip tubes according to the invention allows for containers of varying height. When the collapsible/extensible portion of the dip tube is in its fully extended, relaxed state in a container, adjusts in length as its lower end contacts the bottom of the container. The container may have a small well in the base that pools the last remaining drum content. The bottom of the dip tube may have a "foot" structure to allow liquids to enter its lower end freely. If the drum has a well, the foot fits inside that well.

The collapsible portion is preferably in the form of a compressible and extensible concertina bellows portion.

Optionally, the dip tube as described above may have a location cuff extending radially outwardly from the outside surface of the first tube at a pre-determined distance from its lower end.

The dip tube preferably comprises a distance from the cuff to the lower end of the longer tube greater than the length of the concertina bellows portion of the shorter tube when the bellows portion is uncompressed.

The dip tube may be provided with a foot portion at the lower portion of the second tube. This may involve the foot portion and lower portion comprising a single piece or may require the attachment of one to the other by any suitable attachment means.

BRIEF DESCRIPTION OF THE DRAWINGS

The invention is described with reference to the accompanying drawings showing a presently preferred embodiment and variation as examples.

DETAILED DESCRIPTION OF THE PREFERRED EMBODIMENT

Figure 1:
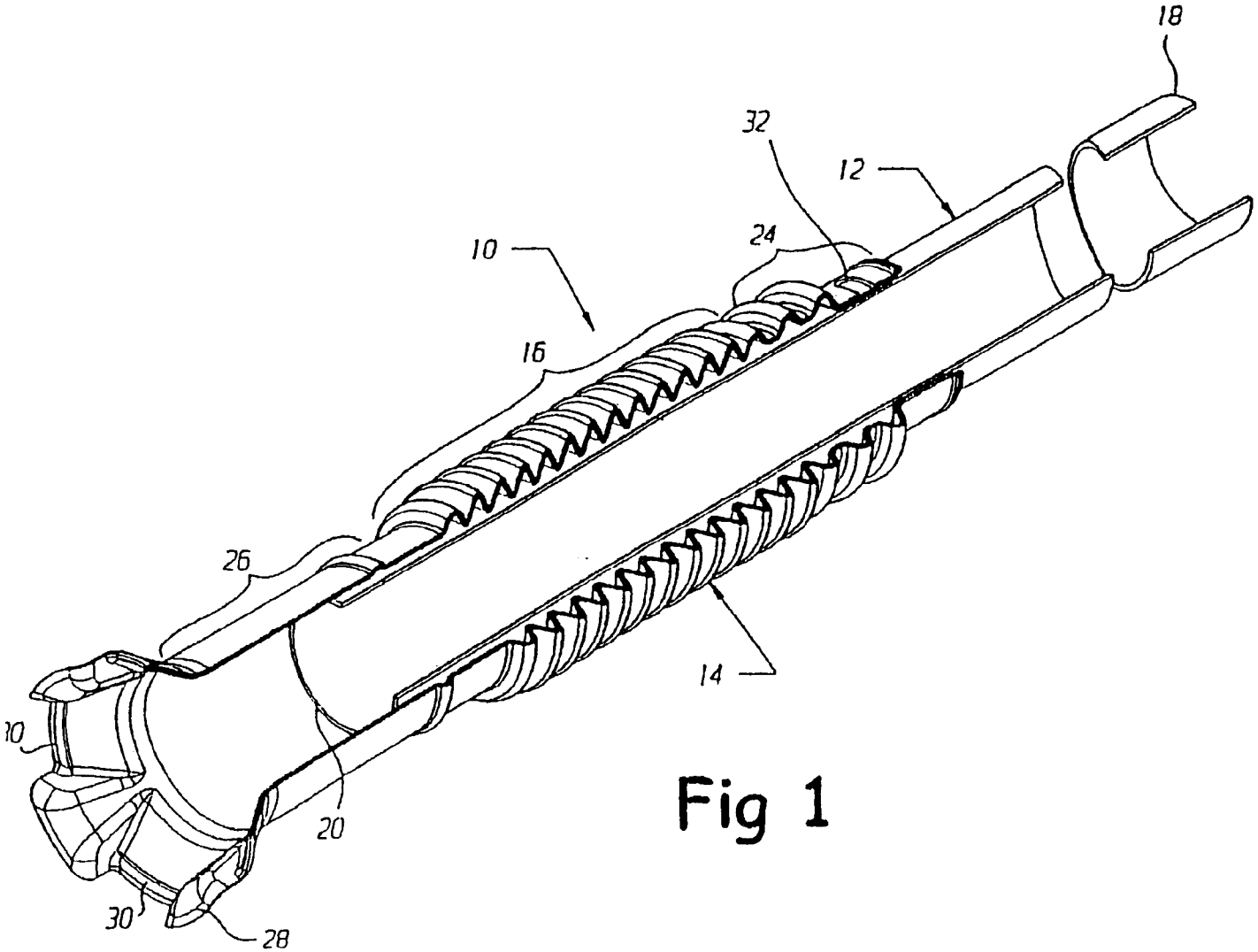
FIG. 1 is an unscaled perspective view of the dip tube according to the invention, shown in partially cut-away form for clarity.

FIG. 1 shows a variable-length dip tube 10 suitable for connection to a dry-break valve closure for a container. It has two component parts, including a longer tube 12 and, to fit over the longer tube in the manner of a sleeve, a shorter tube 14. The shorter tube includes an easily compressible and extensible concertina bellows 16. The longer tube is straight, relatively rigid and attachable at its top end 18 to a pump or valve for insertion into a container. At a predetermined distance from its other end 20, it has an ultrasonically welded patch 32 to fix the shorter tube to the longer in the required position. The concertina bellows is between two portions 24, 26 of straight, relatively rigid plain tube. The upper end 24 of this tube has an inside diameter just larger than the outside diameter of the longer tube and makes fluid tight contact with the outside surface of the longer tube adjacent to the welded patch 32. The remainder of the shorter tube, including the concertina bellows and the second end portion are loose clearance fits, thereby acting as a sleeve over the open end of the longer tube. The lower end of the shorter tube has, as part of the one-piece moulding, a foot 28 that contacts the bottom of the drum and has channels which guide the flow of liquid from the drum into the dip-tube. The foot has a diameter that fits inside a small well in the bottom wall of the container, into which the remaining liquid drains when the container is almost empty. This ensures maximum possible emptying of the drum.

The length of the longer tube is determined in advance of providing the dip tube for a particular application. When assembled to the particular valve or pump desired, it must be short enough not to touch the bottom of the shortest drum or container in which it is to be installed. However, it must be not so short that the shorter tube, when fully extended, does not fall short of touching the base of the drum, since, otherwise, all the contents could not be withdrawn. When correctly sized, the length of the longer tube will result in the all drums of the required nominal capacity being substantially completely emptied, regardless of individual manufacturing process-based variances in their inside height between the bung-hole and the bottom wall vertically below the bung-hole.

The two tube components are made of polypropylene of a grade suitable for extrusion of the longer tube and blow moulding of the concertina tube and suitable for resisting environmental stress-cracking by substances which are prone to induce environmental stress-crack failure in many commodity plastics resinous materials such as used for container and closure manufacture. Both parts may be made from the same grade of polypropylene, such as Montel HET 6100, available from Montel Technology Company by of Netherlands. They may alternatively be made from Qenos (formerly Chemcor) HD1155 or GF7660 grades of high density polyethylene (HDPE) supplied by Qenos of Altona, Victoria, Australia.

Figure 2:
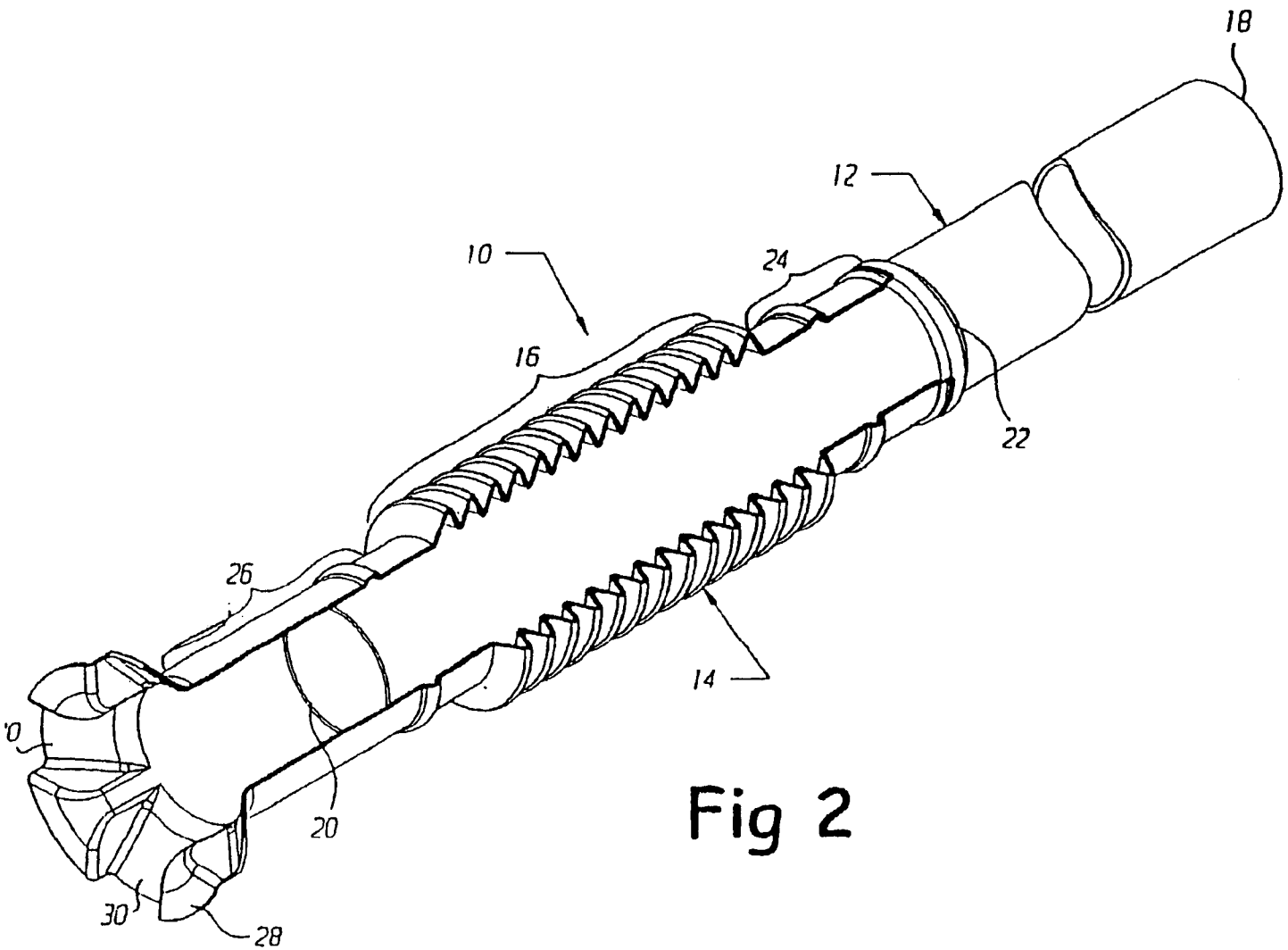
FIG. 2 is an unscaled perspective view of a further embodiment of dip tube according to the invention, shown in partially cut-away form for clarity.

FIG. 2 shows an embodiment of dip tube according to the invention identical in every way to the embodiment shown in FIG. 1 except that the longer tube 12 may have, at a pre-determined distance from its ends 18, 20, a circumferentially extending cuff 22 to provide a location stop to assist positioning the shorter tube to the longer where it is fixed. The cuff 22 can be a full circumferential ring of outside diameter greater than that of the remainder of the longer tube. The exact outside diameter is not crucial but it may be approximately the same as the outside diameter of the shorter tube. The cuff 22 provides a positive location when assembling the shorter tube to the longer tube. The cuff 22 may be separately formed and attached to the longer tube 12 such as by fusion, adhesive bonding or shrinking on.

Optional features or preferences may be varied from the above descriptions. For example, environmental stress-cracking resistant grades of polypropylene or HDPE are not essential if a particular application does not involve any particular substance inducing that mode of failure. The present invention provides substantial advantage because the rigidity of the longer tube prevents failures caused by lateral displacement of the lower end of the already known dip tube of the type used with the Micromatic valve. The presence of the foot moulding as illustrated is not essential. The end of the shorter tube could instead be cut at a suitable angle such as 45° to ensure an entry path for liquid. Likewise, the lower end of the longer, inner, tube could be cut at a similar angle to ensure that in the case of it reaching very close to the bottom of a particularly short drum, that there would not be any tendency to block or be restricted should it otherwise have a minimal clearance between it and the lower drum wall. Optionally, the shorter tube could be shrunk onto the longer rather than being necessarily fused.

What is claimed is:

1. A variable-length dip tube suitable for connection to a closure for a container comprising: a first tube and a second tube, one of which is attachable to a closure for a container, the first tube is of a fixed length and is adapted to fit inside the second tube, the second tube has a collapsible and extensible portion intermediate an upper and lower end portions of the second tube, at least a part of the upper end portion being in fluid tight contact with the first tube at a distance from the lower end of the first tube.

2. The dip tube of claim 1, wherein said collapsible and extensible portion includes a concertina bellows portion.

3. The dip tube of claim 1 or 2 having in addition a cuff extending radially outwardly from the outside surface of the first tube at a predetermined distance from its lower end.

4. The dip tube of claim 2, wherein said predetermined distance is greater than the length of the collapsible and extensible portion of the second tube when that portion is uncompressed.

5. The dip tube of any one of preceding claims 1 and 2 further including a foot portion at the lower end portion of the second tube.

6. The dip tube of claim 5, wherein the foot portion and the lower end portion of the second tube are formed as one piece.

7. The dip tube of any one of preceding claims 1 and 2, wherein the first and second tubes are formed from environmental stress crack-resistant grades of plastics resin.

8. The dip tube of any one of preceding claims 1 and 2, in which the second tube portion is blow-moulded while the first portion is extruded.

9. The dip tube of claim 7, wherein the tubes are formed from the same environmental stress crack-resistant grade of polypropylene.

10. The dip tube of any one of preceding claims 1 and 2, wherein the second tube is fused joined to the first tube.

11. The dip tube of claim 10 wherein the second tube is fused joined to the first tube by ultrasonic welding.

12. The dip tube of any one of preceding claims 1 and 2, wherein the first tube has a length such that its lower end extends to a position close to or just below the end of the collapsible and extensible portion when extended so that the first tube inhibits bending of the collapsible and extensible portion.

* * * * *

UNITED STATES PATENT AND TRADEMARK OFFICE

CERTIFICATE OF CORRECTION

PATENT NO. : 6,695,179 B2
DATED : February 24, 2004
INVENTOR(S) : Frank Mandile

It is certified that error appears in the above-identified patent and that said Letters Patent is hereby corrected as shown below:

Column 2,
Line 46, after “channels” insert -- 30 --

Column 4,
Line 10, after “tube.” insert -- Said collapsible and extensible portion being a loose clearance fit over the first tube. --

Signed and Sealed this

Eighteenth Day of May, 2004

JON W. DUDAS
*Acting Director of the United States Patent and Trademark Office*